US005699075A

United States Patent [19]

Miyamoto

[11] Patent Number: 5,699,075

[45] Date of Patent: Dec. 16, 1997

[54] DISPLAY DRIVING APPARATUS AND INFORMATION PROCESSING SYSTEM

[75] Inventor: Katsuhiro Miyamoto, Isehara, Japan

[73] Assignee: Canon Kabushiki Kaisha, Tokyo, Japan

[21] Appl. No.: 420,318

[22] Filed: Apr. 10, 1995

Related U.S. Application Data

[63] Continuation of Ser. No. 10,294, Jan. 28, 1993, abandoned.

[30] Foreign Application Priority Data

Jan. 31, 1992 [JP] Japan ..... 4-42429

[51] Int. Cl.[6] ..... G09G 3/36

[52] U.S. Cl. ..... 345/97; 345/94

[58] Field of Search ..... 345/87, 97, 94, 345/95, 96, 99, 208, 209, 210; 309/55, 56

[56] References Cited

U.S. PATENT DOCUMENTS

| | | | |
|---|---|---|---|
| 4,655,561 | 4/1987 | Kanbe et al. . | |
| 4,693,563 | 9/1987 | Harada et al. | 350/350 |
| 4,857,906 | 8/1989 | Conner | 345/97 |
| 4,964,699 | 10/1990 | Inoue | 345/97 |
| 5,091,723 | 2/1992 | Kanno et al. . | |
| 5,136,282 | 8/1992 | Inaba et al. | 345/97 |

FOREIGN PATENT DOCUMENTS

| | | | |
|---|---|---|---|
| 0368117 | 5/1990 | European Pat. Off. | 345/97 |
| 63-65494 | 3/1988 | Japan . | |
| 160499 | 6/1990 | Japan . | |
| 4-3114 | 1/1992 | Japan | 345/97 |

*Primary Examiner*—Regina D. Liang

*Attorney, Agent, or Firm*—Fitzpatrick, Cella, Harper & Scinto

[57] ABSTRACT

The present invention provides a display driving apparatus which can improve a picture quality by smoothly switching a partial writing mode and a refresh driving mode and also provides an information processing system having such a display driving apparatus. When a controller 7 discriminates the partial writing mode by a discrimination signal PH/RL, the controller generates a picture data request signal BUSY to a graphic controller 6, reads out data on a data line PIX DATA, and sets a scan address into a driver controller 12 in accordance with the value of the read data. When the discrimination signal PH/RL is switched from the partial writing mode to the refresh driving mode, in order to restart the refresh driving mode, the controller 7 directly rears a count value of an HSYNC counter 17 and calculates a scan address of the next refresh data in accordance with such a value and sets into the driver controller 12.

7 Claims, 8 Drawing Sheets

COMMON DRIVER
FLC PANEL
SEGMENT DRIVER
DRIVER CONTROLLER
SYSTEM CLOCK
DRIVER IC CLOCK
BORDER IMAGE CONTROLLER
A/D
SDI, ID
IRQ1
DGATE
CONTROLLER
SKIP CONTROLLER
SPEED CONVERSION CONTROLLER
FLCDC
PH/RL
VSYNC
BUSY
HSYNC
DOTCLK
DISP
AH/DL
PIX DATA
HOST CPU
GRAPHIC CONTROLLER
PARTIAL WRITE CONTROLLER
1
2
3
4
5
6
7
8
9
10
11
12
13
14
15

DISPLAY DRIVING APPARATUS AND INFORMATION PROCESSING SYSTEM

This application is a continuation of application Ser. No. 08/010,294, filed Jan. 28, 1993 now abandoned.

BACKGROUND OF THE INVENTION

1. Field of the Invention

The present invention relates to a display driving apparatus for displaying by applying a scan signal and information signal to a display apparatus in which scan signal lines and information signal lines are arranged in a matrix form and, more particularly, to a display driving apparatus suitable for a display apparatus such as a ferroelectric liquid crystal (FLC) display apparatus having a memory performance and a temperature dependency and also relates to an information processing system having such a display driving apparatus.

2. Related Background Art

In recent years, as for a display system such as a liquid crystal display apparatus or the like which is required in an information processing system such as personal computer, work station, or the like, a size of screen and a resolution are being more and more increased every year. On the other hand, a compatibility of such a display system with a conventional apparatus is required. Particularly, in the display apparatus having a memory performance such as a ferroelectric liquid crystal (FLC) display apparatus or the like, its fundamental operation principle is different from that of a CRT (cathode ray tube), an STN-LCD (super twisted nematic liquid crystal display), or a PDP (plasm display panel) which is used in the conventional display apparatus, so that various methods for realizing a display system of a large screen and a high resolution have been proposed.

As a conventional method proposed, there is made a trial such that a partial writing scanning method using the memory performance which has been proposed by U.S. Pat. No. 4,655,561 by Kanbe et al. is realized by a "low frame frequency driving+partial writing scanning" method for displaying at a high resolution in the display apparatus having the memory performance in JP-A-63-65494 (U.S. Pat. No. 5,091,723) proposed by INOUE et al.

Such a low frame frequency driving method relates to an external synchronizing method whereby a timing to receive image information is requested to the image information supply side in accordance with a temperature around the ferroelectric liquid crystal in order to correct temperature characteristics of the ferroelectric liquid crystal. On the other hand, a ferroelectric liquid crystal control apparatus detects a temperature around a ferroelectric liquid crystal display panel and recognizes a time which is necessary to write information of one line of the ferroelectric liquid crystal display panel. A graphic controller manages a transferring method of the image information written into a video RAM (VRAM) by a host CPU. After completion of the writing of the information of one line, the FLC control apparatus sends an image information request signal (BUSY signal) to the graphic controller. When the BUSY signal is recognized, the graphic controller transfers the image information of one line from the VRAM to the FLC driving apparatus. Hereinafter, the above operation is repeated every line.

When a temperature is low, a writing speed decreases due to the temperature characteristics of the ferroelectric liquid crystal and a frame frequency decreases, so that a change in method of receiving the image information of one line, practically speaking, a change in number of lines to be interlaced due to the ambient temperature is requested from the FLC driving apparatus to the graphic controller.

However, the above external synchronizing method and the interlace change request are functions which are unnecessary to a display apparatus such as a CRT or the like in which the writing speed and frame frequency are not changed depending on the temperature. Therefore, to add such functions to a display apparatus for a ferroelectric liquid crystal, a software called BIOS which is provided in the graphic controller and manages the image information must be changed. This results in a loss of compatibility of a drawing speed for an application software constructed for the CRT.

To solve the above problem, accordingly, an interlace display method for thinning out the image data so as not to change the software constructed for the CRT has been proposed (refer to Japanese Patent Application No. 2-160499). According to such a method, however, when an external temperature drops, the time which is required to write the information of one line of the liquid crystal display panel increases, so that the number of lines to thin out the image data must be increased. Therefore, when the host CPU updates the data in the VRAM for a period of time during which the information of one frame is drawn on the LCD panel, the image data is coarsely displayed on a line unit basis. Due to such a coarse display, there occurs a problem such that it is difficult to designate a point in case of a display such that a point of a mouse, a cursor, or the like as a pointing device is designated.

In the case where a problem occurs when the image data is coarsely displayed like a pointing device, it is necessary to Use a controller which is constructed in a manner such that the line accessed to the VRAM in a certain time is detected and a partial writing operation (non-interlace scan) is executed by the external synchronous manner within a range in which the software is not changed, and an operating mode is switched to an interlace scan (refresh driving) due to the thin-out of the image data for the other lines.

Such a display switching method, however, has the following two problems. First, a scanning line whose scan is restarted when the operating mode is switched from the partial writing mode to the refresh driving mode must be detected. In the partial writing mode, the address of the scanning line is received as a pair together with the line data by an image data request signal (BUSY signal) from the controller and the data is displayed in accordance with the scan address received. In the refresh driving mode, on the other hand, the data is merely sequentially transferred synchronously with a horizontal sync signal in a manner similar to the case of the CRT, so that scan address information is not transferred. Therefore, the scanning line whose scan is restarted when the operating mode is switched from the partial writing mode to the refresh driving mode is obscure.

Second, since driving waveform in the partial writing mode differs from a driving waveform in the refresh driving mode, a contrast of the panel fluctuates each time the operating mode is switched, so that a flickering state occurs on the screen. In the partial writing mode, when the writing of the data of one line is finished on the FLC panel side, the next data is received. Therefore, no pause is generated on a driving waveform. In the refresh driving mode, on the other hand, since the timing to write the data of one line is limited to a timing which is integer times as large as the horizontal sync signal, a pause period is provided on a driving waveform in order to synchronize with the time at which the FLC panel can write the data of one line.

SUMMARY OF THE INVENTION

In consideration of the above problems of the conventional systems, it is an object of the present invention to provide a display driving apparatus which can improve a picture quality by smoothly switching the partial writing mode and the refresh driving mode for a display apparatus such as a ferroelectric liquid crystal display panel having a memory performance and a temperature dependency and also to provide an information processing system having such a display driving apparatus.

To accomplish the above object, according to the invention, there is provided a display driving apparatus for allowing a display apparatus having a memory performance and a temperature dependency to display image data from the image information supply side by a partial writing mode or a refresh driving mode, wherein the display driving apparatus has: a control line to discriminate whether the image data which is transferred from the image information supply side to the display apparatus side is image data for the partial writing mode or image data for the refresh driving mode; and control means for selectively switching the partial writing mode and the refresh driving mode of the display apparatus in accordance with a discrimination signal on the control line.

Another object of the invention is to provide a display driving apparatus in which the above control means comprises: synchronizing means for recognizing a field by a vertical sync signal of the image data from the image information supply side and for counting a horizontal sync signal in both of the partial writing mode and the refresh driving mode; and calculating means for calculating a scanning line and a field at a time point when a driving mode is restarted from the partial writing mode to the refresh driving mode on the basis of a count value of the synchronizing means.

Still another object of the invention is to provide a display driving apparatus for supplying an image data request signal which is synchronized with a period that is integer times as high as the horizontal sync signal to the image information supply side by the control means in the partial writing mode.

DETAILED DESCRIPTION OF THE PREFERRED EMBODIMENTS

An embodiment of the present invention will be described in detail hereinbelow with reference to the drawings.

Figure 1:
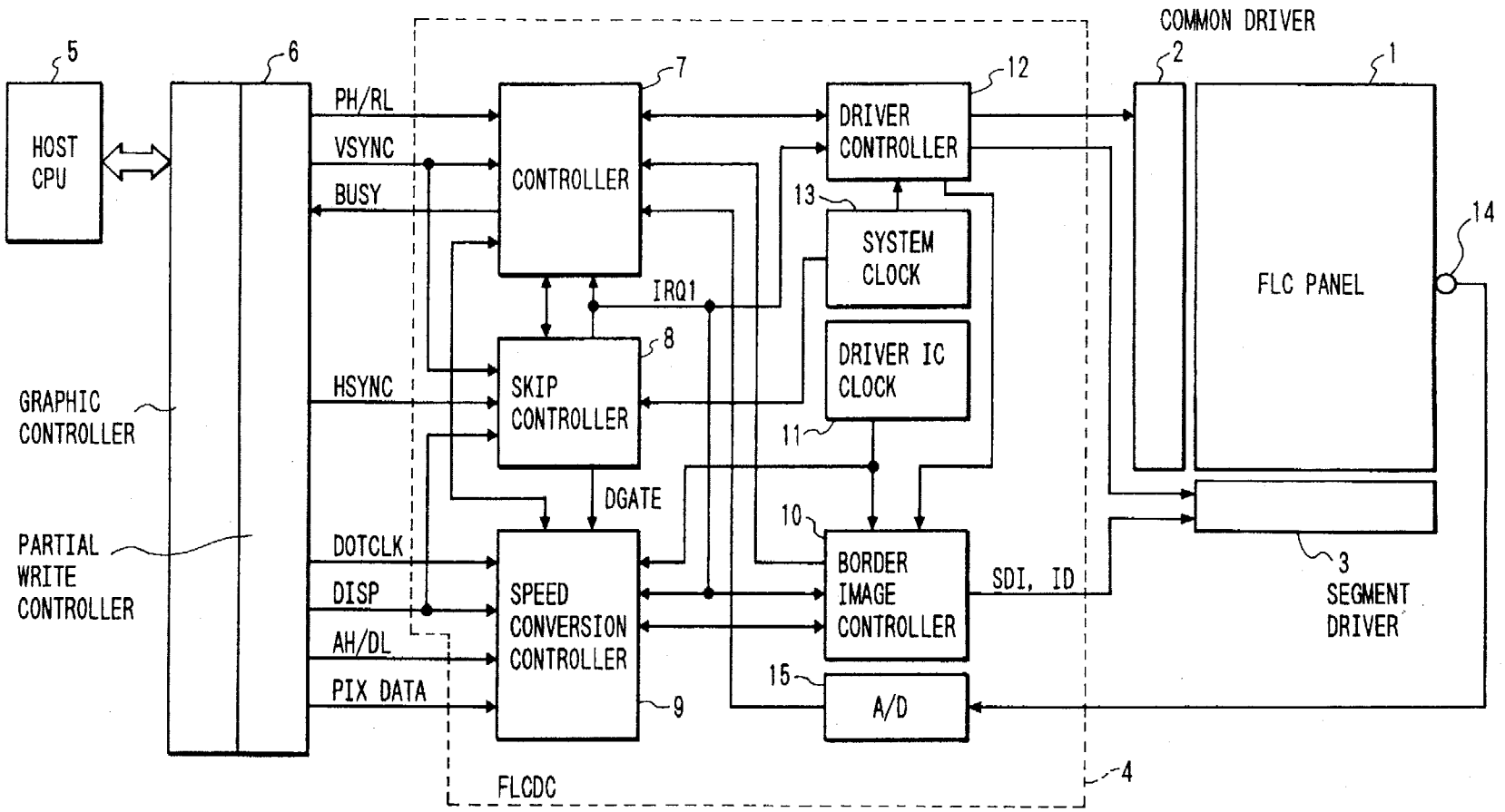
FIG. 1 is a block diagram showing a construction of an embodiment of an information processing system having a display driving apparatus according to the present invention.

In FIG. 1, an FLC panel (ferroelectric liquid crystal display panel) 1 is driven by a common (scanning line) driver 2 and a segment (information line) driver 3. The common driver 2 can access an arbitrary lime by designating a scan address of the FLC panel 1. The common driver 2 and the segment driver 3 are driven by a ferroelectric liquid crystal driving apparatus (FLCDC) 4 of the embodiment. A host CPU 5 is constructed by, for example, a personal computer (PC AT architecture) made by IBM Corporation. The host CPU 5 is connected to the FLCDC 4 through a graphic controller and partial write controller 6 such as a VGA or the like to perform a display control of the host CPU 5. The FLCDC 4 displays the information from the host CPU 5 onto the FLC panel 1. A VRAM is provided in the graphic controller 6.

Figure 2:
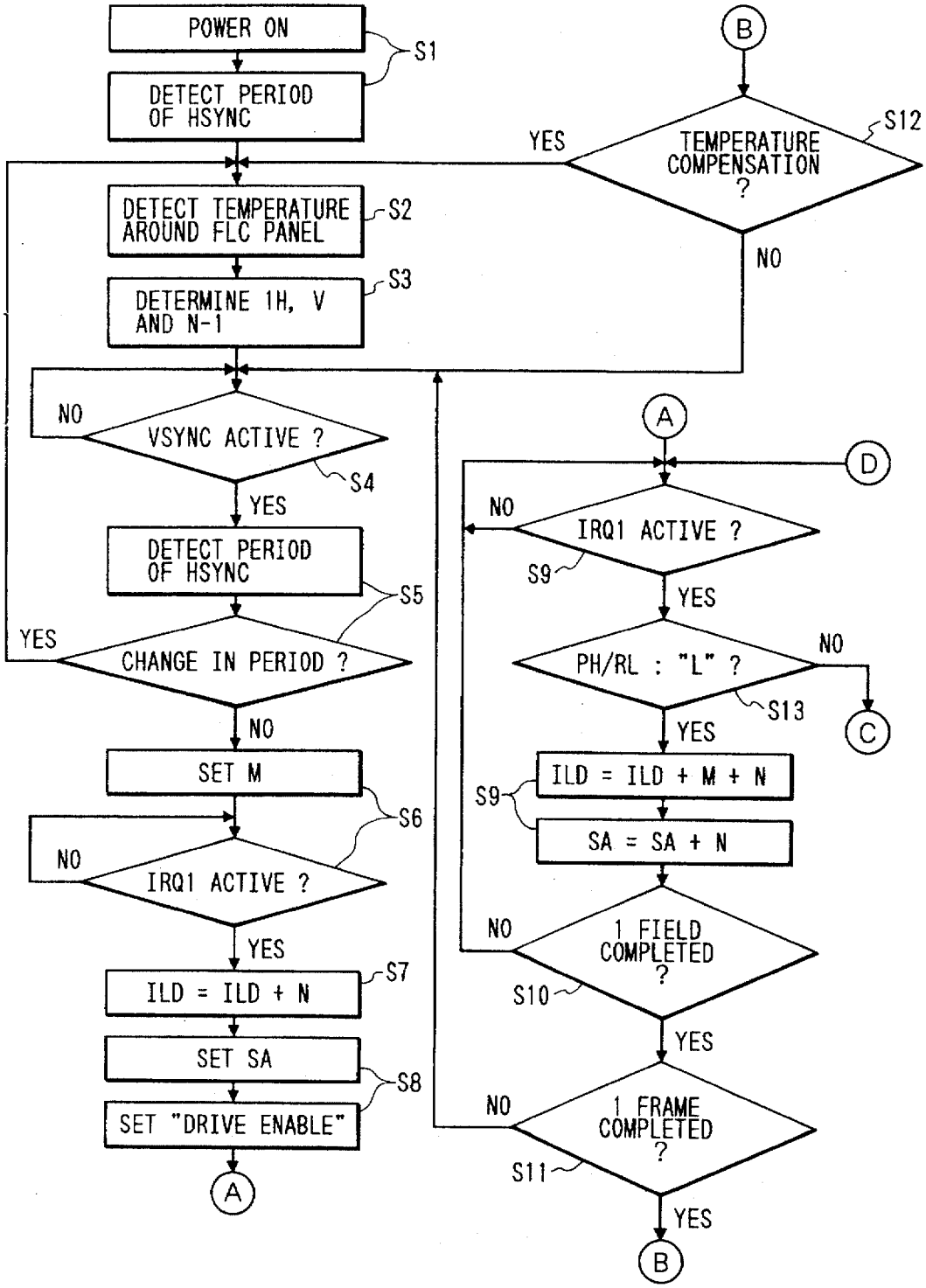
FIG. 2 is a flowchart showing a main operation in the refresh driving mode of a ferroelectric liquid crystal driving apparatus (FLCDC) in FIG. 1 and a switching operation between the partial writing mode and the refresh driving mode.
Figure 7:
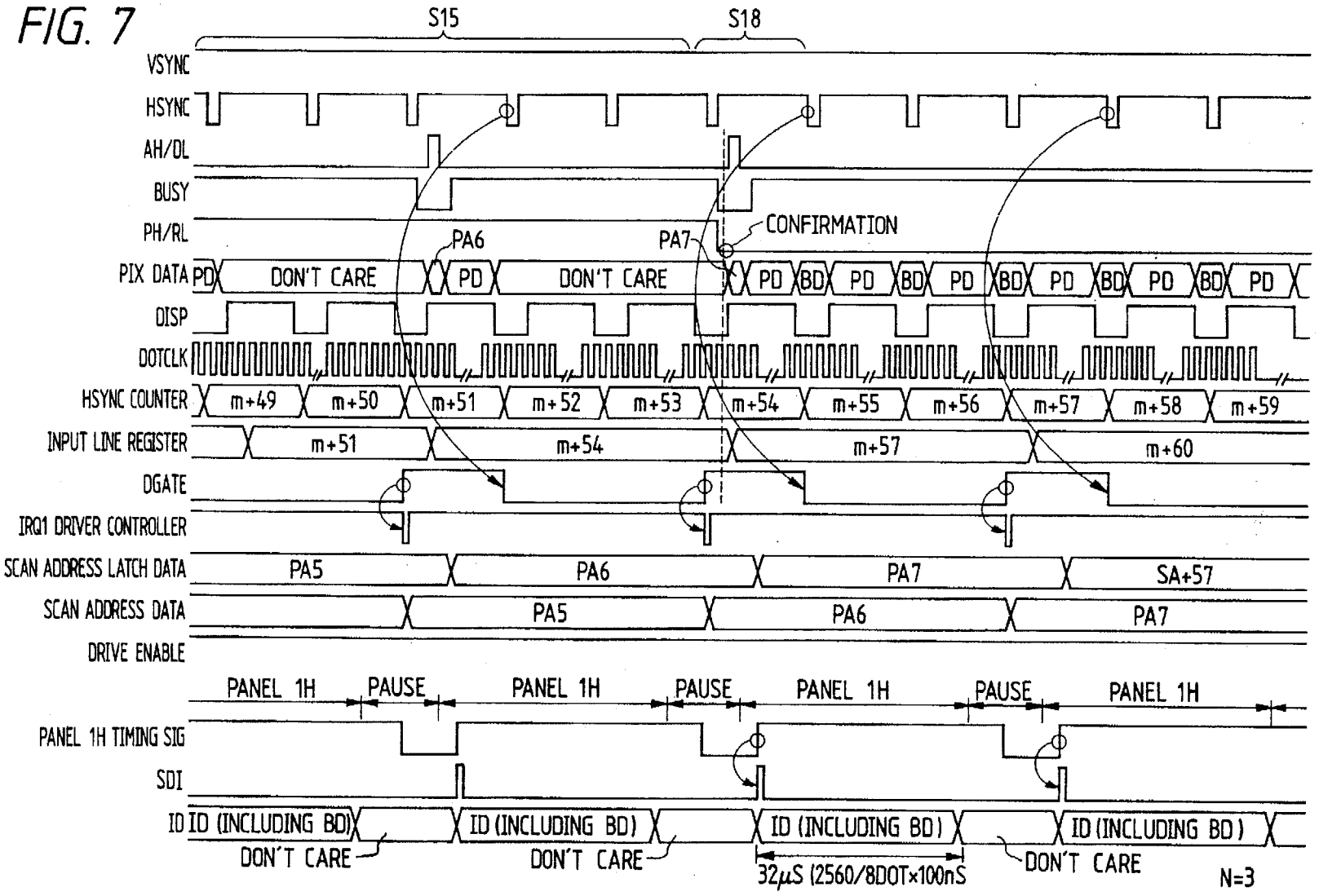
FIG. 7 is a timing chart showing main signals when switching from the partial writing mode to the refresh driving mode.

A construction of the FLCDC 4 will now be described. A controller 7 has a processor and a memory to store programs which are executed by the processor, for example, control procedures shown in FIGS. 2 and 7. The controller 7 controls the execution of the operating procedures of the FLCDC 4 as shown in FIGS. 2 and 7. An image data line skip controller (SKIP) 8 executes a control to thin out picture data PD (which will be explained hereinlater) from the graphic controller 6 on a line unit basis as shown in detail in FIG. 3. An image data transfer speed conversion controller 9 converts the picture data PD from the graphic controller 6 to a transfer speed and a timing which are suitable for the segment driver 3. A border image data controller 10 generates data to interpolate regions corresponding to differences between the numbers of physical display dots in the vertical and lateral directions of the FLC panel 1 and the numbers of display dots in the vertical and lateral directions which are designated by the graphic controller 6 when those numbers are different.

A driver IC clock 11 produces a transfer clock of the segment driver 3. A driver controller 12 generates driving waveform control signals which are proper to the common driver 2 and segment driver 3, thereby controlling the writing timing of one line of the FLC panel 1. A system clock 13 produces a system clock of the FLCDC 4. A temperature around the FLC panel 1 is detected by a temperature sensor 14 and supplied to the controller 7 through an A/D converter 15.

Signals which are transmitted and received between the FLCDC 4 and the graphic controller 6 will now be described. Those signals are necessary to supply image data to an ordinary CRT and include signals which are generated from a standard graphic controller (VGA or the like) and control signals necessary in the partial writing mode.

(Signal which is necessary in the refresh driving mode)

(1) DISP . . . Display enable signal. When the signal DISP is set to the high "H" level, picture data PD is supplied to a data line PIX DATA. When it is set to the low "L" level, border data BD is supplied.

(Signals which are necessary in the partial writing mode)

(2) BUSY . . . Picture data request signal which is supplied from the FLCDC 4 to the graphic controller 6. Each time the signal BUSY is set to the "L" level, the picture data of one line is transferred to the FLCDC 4.

(3) AH/DL . . . Discrimination signal of the picture data which is transferred from the graphic controller 6 and the scan address (in order to multiplex the picture data and the scan address on the data line PIX DATA).

(Signals which are commonly necessary)

(4) VSYNC . . . Vertical sync signal to determine the timing of one frame. In case of VGA, a period of the signal VSYNC is set to 1/70 (sec) or 1/60 (sec).

(5) HSYNC . . . Horizontal sync signal to determine the timing of one line. In case of VGA, a period of the signal HSYNC is set to 31.8 μsec.

(6) PIX DATA . . . Picture data signal line. Signal line on which the picture data PD written in the VRAM in the graphic controller 6 and the scan address signal in the partial writing mode are multiplexed by the host CPU 5.

(7) DOTCLK . . . Dot clock signal to determine the timing of one dot of the picture data line PIX DATA.

(8) PH/RL . . . Discrimination signal to discriminate the partial writing mode (when it is set to the "H" level) and the refresh driving mode ("L" level).

The operation of the FLCDC 4 will now be described with reference to FIGS. 2 to 8. The graphic controller 6 generates the Signals excluding the picture data request signal BUSY to the FLCDC 4 by the same timing and procedure as those of the CRT by the internal software to manage the VRAM called BIOS. First, the operation in the refresh driving mode will be described in accordance with processing steps S1 to S12 shown in FIGS. 2 and 3 and with reference to FIG. 5. In step S1, when a power supply of the FLCDC 4 is turned on, an HSYNC-period detector 20 in the picture data line skip controller 8 shown in FIG. 4 detects the number of reference clocks which are generated from the system clock 13 for a period of time from the horizontal sync signal HSYNC to the vertical sync signal VSYNC, so that a period of time of the horizontal sync signal HSYNC is detected and the horizontal period data is sent to the controller 7.

In step S2, the temperature around the FLC panel 1 detected by the temperature sensor 14 is sent to the controller 7 via the A/D converter 15. In step S3, a writing period of time (1 H) and a driving voltage V which are necessary to write the picture data of one line of the FLC panel 1 are determined in accordance with the detected temperature. The number of lines (N−1) which are thinned out in case of thinning out every line is determined by the writing period of time (1 H) and the horizontal period data. The number N of lines is decided by the following equation. This equation denotes that the picture data is drawn on the FLC panel 1 by interlacing N lines.

$$N=1\ H/\text{horizontal period data}$$

(where, figures below decimal point are raised to a unit)

When the controller 7 calculates the writing period of time (1 H), driving voltage V, and interval for thinning out the lines, the controller 7 waits until the vertical sync signal VSYNC from the graphic controller 6 is made active in step S4. When it is recognized that the signal VSYNC is made active, the detected period is compared with the above horizontal period data in step S5 and the horizontal period data is again detected in order to check to see if there is a change in period of the horizontal period data or not. This is because there is a case where the horizontal period data is changed by the host CPU 5 in dependence on the graphic controller 6. When there is a change in period of the horizontal period data, the processing routine is returned to step S2 and the procedure to change the writing period of time (1 H) and the driving voltage V is repeated. Such an operation is executed each time the vertical sync signal VSYNC is made active.

In subsequent step S6, the controller 7 sets the output timing of the picture data which has been preset between the controller 7 and the graphic controller 6 into an input line register 16. Practically speaking, initial input line data M according to the result of detection indicating that the picture data PD is generated from how many horizontal sync signals HSYNC after the vertical sync signal VSYNC was made active is set into the input line register 16. An HSYNC counter 17 is reset by the vertical sync signal VSYNC and counts up the count value of the horizontal sync signals HSYNC. The increased count value is compared with the initial input line data M by a comparator 18.

Figure 5:
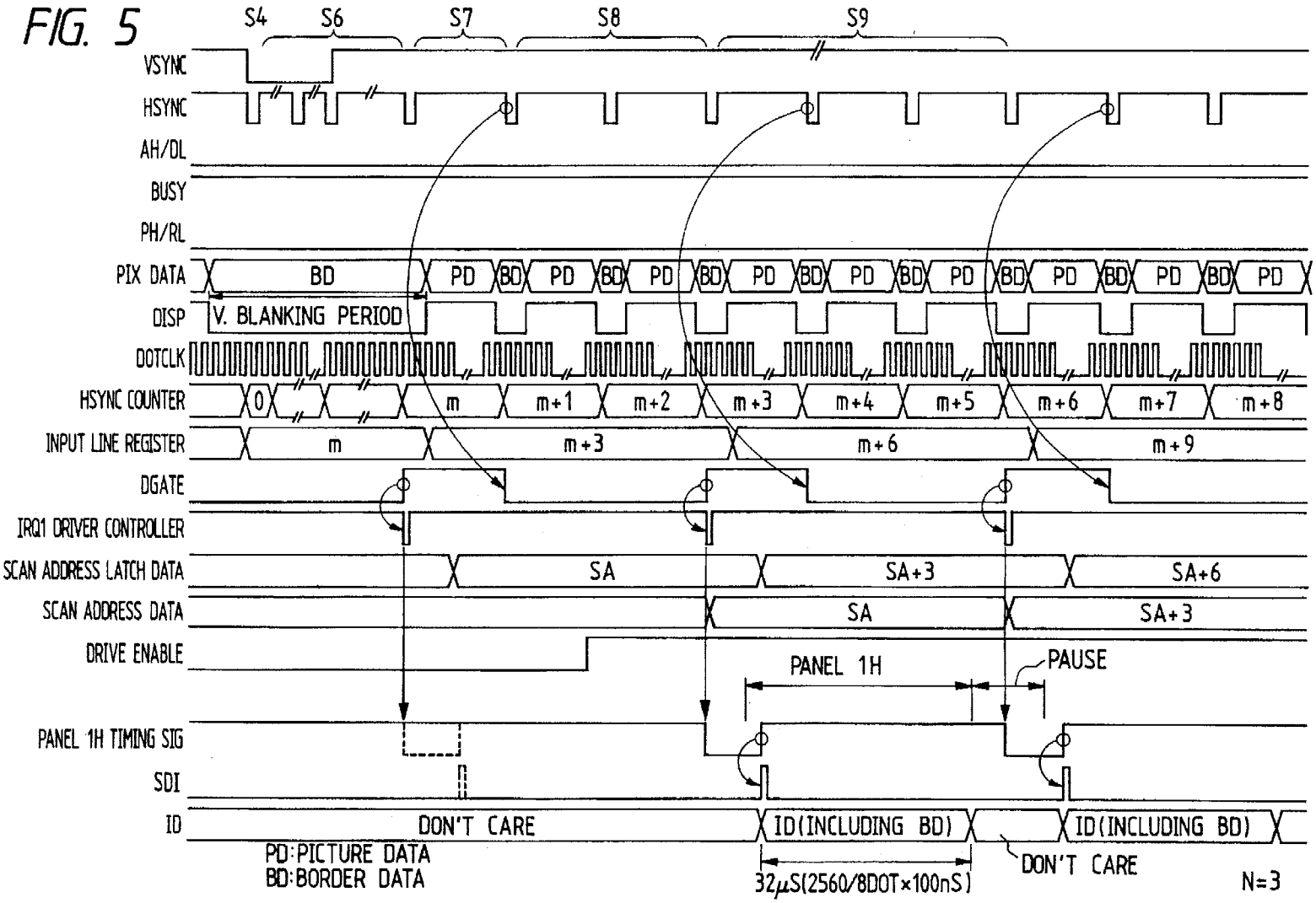
FIG. 5 is a timing chart showing main signals in an image data line skip controller in FIG. 4.

As shown in FIG. 5, when they coincide, the comparator 18 generates a gate signal DGATE which is held to the high level until the next horizontal sync signal HSYNC rises. An interruption signal generator 19 generates an interruption signal IRQ1 in response to a leading edge of the gate signal DGATE and supplies to the controller 7.

By the interruption signal IRQ1, the controller 7 can recognize that the picture data PD of the line set in the input line register 16 has been transferred. In step S7, the data of the input line which is subsequently necessary is set into the input line register 16. Such a data is equal to the value which is obtained by adding the line number N for thinning out the lines to previous input line data ILD (=M) (the number of lines to be thinned out is equal to N−1). In the example shown in FIG. 5, since N=3, a value of ILD+3 (=M+3) is set into the input line register 16. The picture data PD on the signal line PIX DATA is supplied to the image data transfer speed conversion controller 9 for such a period of time.

In step S8, the controller 7 sets initial scanning line latch data SA to write to the FLC panel 1 into the driver controller 12. As shown in FIG. 5, the controller 7 also generates drive enable signals to drive the drivers 2 and 3 to the driver controller 12. When the drive enable signal is set to the high level, the driver controller 12 makes a trigger signal SDI to transfer the picture data to the segment driver 3 and a panel 1 H timing signal to determine the period of time 1 H of the FLC panel 1 active, respectively.

In step S9, the controller 7 subsequently waits for the interruption signal IRQ1 as a transfer recognition signal of the next input line data (M+3) as shown in FIG. 5. When the interruption signal IRQ1 is recognized, the controller 7 sets input line data (M+N+N) and scanning line data (SA+N) which are subsequently necessary into the input line register 16 and driver controller 12, respectively. By the interruption signal IRQ1, the driver controller 12 sets the scanning line latch data SA which has been set in step S8 into the common driver 2. At the same time, the driver controller 12 produces a panel 1 H timing signal and supplies to the drivers 2 and 3. By the above operations, the common driver 2 erases the line SA.

The data of the line SA is written for period of time of next 1 H on the basis of the picture data PD which has been transferred to the segment driver 3. For this period of time, the trigger signal SDI is generated from the driver controller 12. The picture data PD supplied to the controller 9 at the timing in step S7 is transmitted to the segment driver 3 through the border image data controller 10 at a speed adapted to the transfer speed of the drivers 2 and 3. In the example shown in FIG. 5, to perform the area gradation, the picture data of 2560 dots in the case where one pixel consists of four dots is transferred to the segment driver 3 at a period of 100 nsec in an 8-bit parallel transfer method. In this instance, when the period 1 H of the FLC panel 1 is slower than the above speed, the segment driver 3 is held in the standby mode for a period of time corresponding to a difference between those speeds after the picture data was transferred.

In the next step S10, the controller 7 checks to see if the display of one field (one frame for the graphic controller 6) by the FLC panel 1 has been finished or not. For instance, when the addition value of the present input line data ILD and the value N exceeds a value of SAML (the number of scanning lines transferred from the graphic controller 6), the display of one field is finished. Therefore, the processing routine is returned to step S4 through step S11 and the controller 7 waits for the input of the vertical sync signal VSYNC and executes the process of the next field after that. On the other hand, when the display of one field is not finished, the processing routine is returned to step S9.

In step S11, the controller 7 subsequently discriminates whether the field finishing process has been repeated N times or not on the basis of a count value of a field counter provided in the controller 7, thereby judging whether the display of one frame by the FLC panel 1 has been finished or not. When the display of one frame is not finished, the processing routine is returned to step S4 and the process of the next field is executed. In this case, the value of initial input line data M is increased by "+1" to receive the data of the next field. In place of increasing the value of initial input line data M by "+1", by selecting values within a range from 1 to N at random by a certain procedure, a random interlace can be performed.

On the other hand, when the display of one frame is finished in step S11, a check is made in step S1 to see if a timing to compensate the temperature around the FLC panel 1 has come or not on the basis of, for example, the number of frames. In the case where the images of the number as many as a predetermined number of frames have been written to the FLC panel 1, step S2 follows and the writing period of time (1 H) and the driving voltage V which are necessary to write the picture data of one line of the FLC panel 1 are determined in accordance with the detected temperature around the FLC panel 1. The number of lines to be thinned out (N−1) in case of thinning out every line is also decided by the writing period of time (1 H) and the horizontal period data. On the other hand, when the images of the number as many as the predetermined number of frames are not yet written, step S4 follows without compensating such a temperature.

The operations in the refresh driving mode have been described above. A switching operation between the partial writing mode and the refresh driving mode as a feature of the present invention will now be described in accordance with processing steps S13 to S16 shown in FIGS. 2 and 3 and with reference to FIGS. 6 to 8. First, the case of switching from the refresh driving mode to the partial writing mode will be first explained with reference to processing steps S13 to S15 and FIG. 6. When the interruption signal IRQ1 is recognized in step S9, the controller 7 judges a status of the discrimination signal PH/RL regarding the partial writing mode and the refresh driving mode which is transferred from the graphic controller 6 in step S13.

The discrimination signal PH/RL is set to the high level when the graphic controller 6 executes the partial writing mode. The signal PH/RL is switched to the low level when the last partial writing data is transferred in case of executing the refresh driving mode. When the signal PH/RL is at the low level, the graphic controller 6 doesn't transfer the partial writing data, so that the processing routine is returned to step S9 and the above refresh driving mode operation is repeated.

Figure 6:
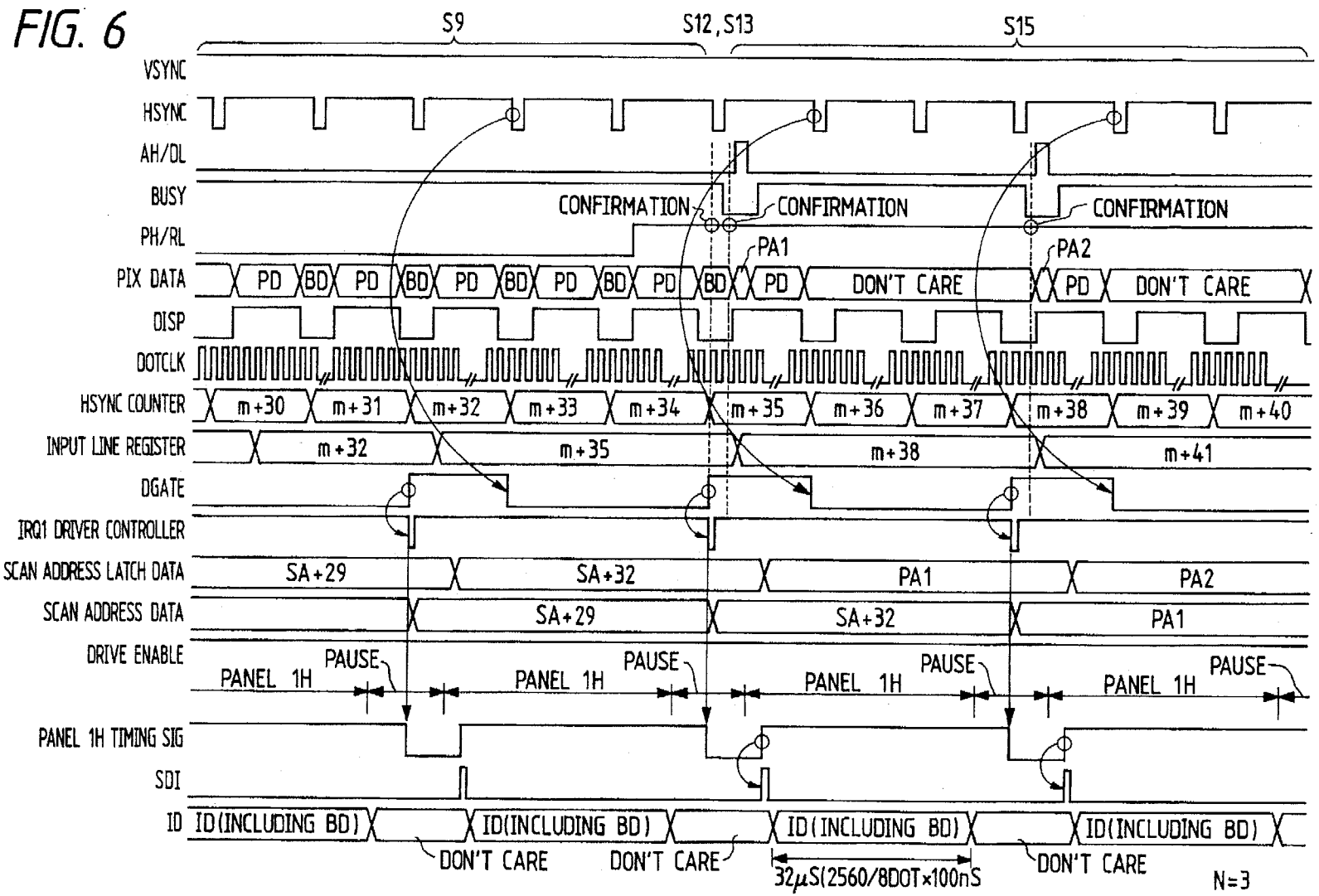
FIG. 6 is a timing chart showing main signals when switching from the refresh driving mode to the partial writing mode.

On the other hand, when the signal PH/RL is set to the high level, the processing routine jumps to step S14 and the picture data request signal BUSY is sent to the graphic controller 6 as shown in FIG. 6 and the field number is also stored in order to restart the refresh driving mode. It should be noted here that the timing to generate the picture data request signal BUSY is generated synchronously with the interruption signal IRQ1 instead of the timing at which the writing of one line of the FLC panel 1 is finished. Due to such a generation timing, the timing to receive the picture data for partial writing is matched with the timing in the refresh driving mode, so that the driving waveforms can be equalized. Therefore, it is possible to suppress the contrast fluctuation and flickering due to the difference of the pause periods of the driving waveforms upon switching as in the conventional system. The timing to generate the picture data request signal BUSY can be also generated synchronously with 1 H of the FLC panel 1.

In the next step S15, the discrimination signal PH/RL is again checked. This is because there is a case where the partial writing operation is executed for only one line and the operating mode is returned to the refresh driving mode. When the signal PH/RL is held at the high level, data PA1 on the data line PIX DATA in this instance is read and the scan address is set into the driver controller 12 in accordance with the value of data PA1. After the discrimination signal AH/DL was set to the low level, the picture data PD on the data line PIX DATA is supplied to the controller 9 and the value which is obtained by adding the value of N into the value of the input line register 16 is set. After that, the partial writing operation is sequentially executed while recognizing the interruption signal IRQ1 in a manner similar to the case of the refresh driving mode.

Figure 3:
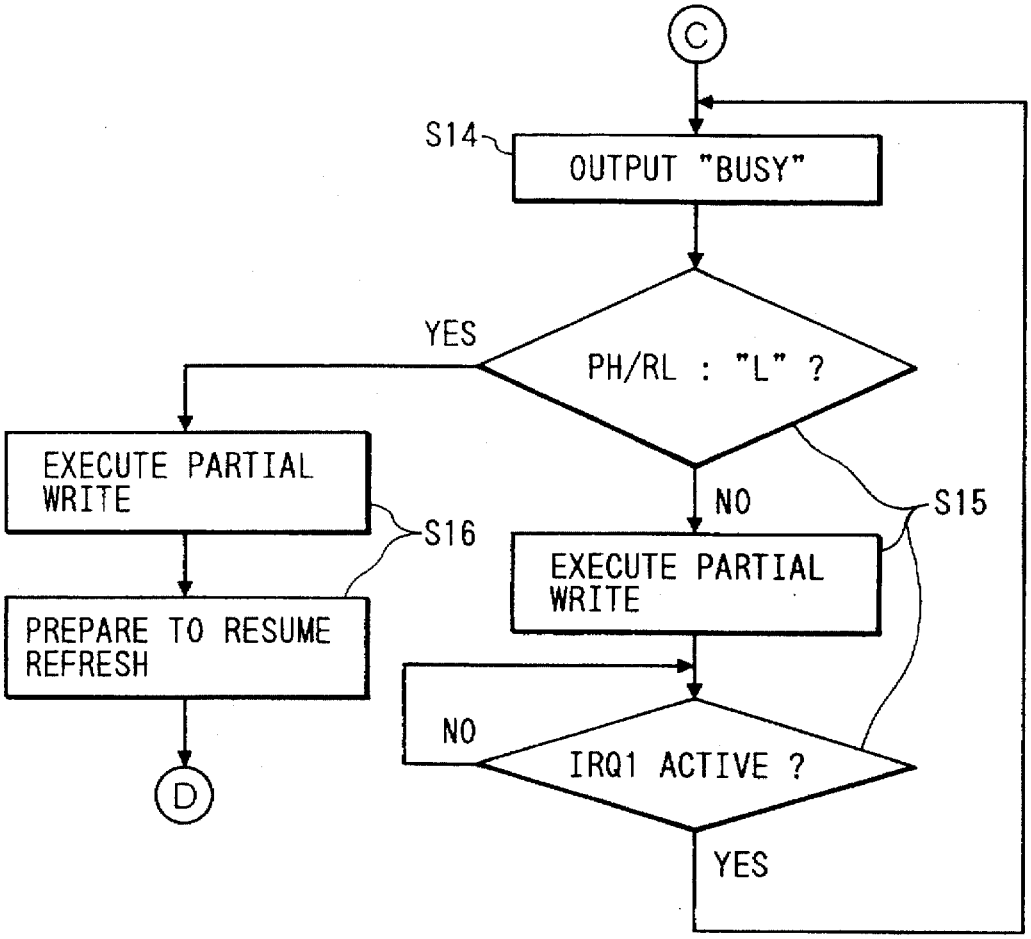
FIG. 3 is a flowchart showing a main operation in the refresh driving mode of the ferroelectric liquid crystal driving apparatus (FLCDC) in FIG. 1 and a switching operation between the partial writing mode and the refresh driving mode.
Figure 8:
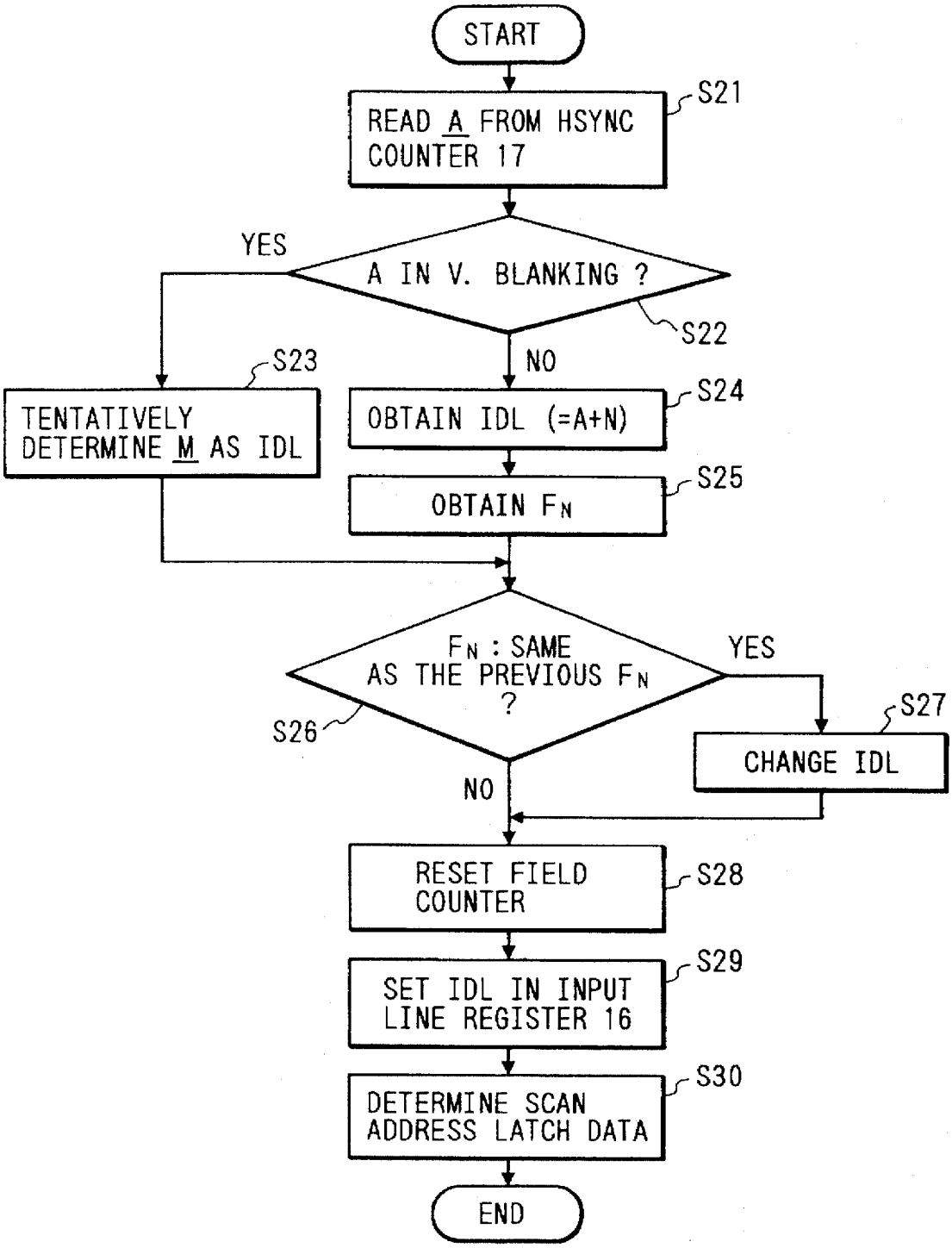
FIG. 8 is a flowchart showing detailed operations of a preparing routine to restart the refresh driving mode shown in FIG. 7.

Lastly, the operations in case of switching from the partial writing mode to the refresh driving mode will now be described with reference to processing step S16 shown in FIGS. 2 and 3 and to FIGS. 7 and 8. The discrimination signal PH/RL is checked in step S15. As shown in FIG. 7, when it is at the low level, it is recognized that the transfer of the partial writing data is the last transfer, so that the processing routine is jumped to step S16. The last scan address data and line data PA7 are supplied in accordance with the timing of the discrimination signal AH/DL in a manner similar to the case in the partial writing mode. The scan address is set into the driver controller 12 and the partial writing operation is executed.

Figure 4:
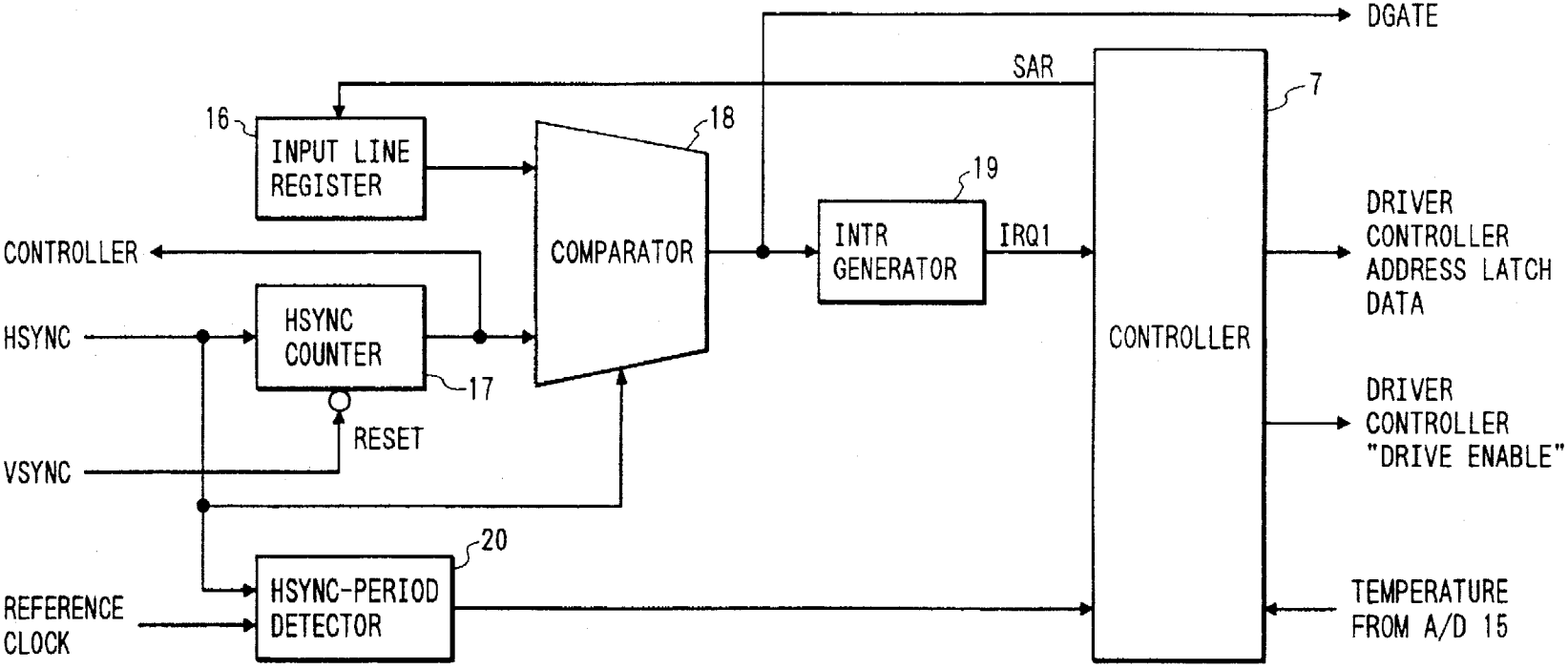
FIG. 4 is a block diagram showing a detailed construction of an image data line skip controller in FIG. 1.

Subsequently, to restart the refresh driving mode, as shown in FIG. 4, the controller 7 directly reads the count value of the HSYNC counter 17 and calculates the scan address of the next refresh data PD in accordance with such a count value as shown in detail in FIG. 8. The scan address is set into the driver controller. 12 and the processing routine is returned to step S9. The refresh driving mode is restarted.

The detailed operation of the preparing routine to restart the refresh driving mode will now be described with reference to FIG. 8. First, the count value A of the HSYNC counter 17 is read (step S21). When the value A lies within a vertical blanking period as shown in FIG. 5, a refresh resume address IDL is tentatively determined to the initial input line data M (steps S22, S23). The initial input line data M is adjusted so that the field of the data M differs from the field at a time point when the operating mode is switched from the refresh driving mode to the partial writing mode. The adjusted initial input line data M is set into the input line register 16 and the processing routine advances to step S26. The scan address is determined by the value of (SA+adjusted value).

On the other hand, when the value A of the HSYNC counter 17 doesn't lie within the vertical blanking period, the processing routine advances from step S22 to step S23 and the value of N is added to the value A, thereby calculating the refresh resume address IDL (=A+N). The field number (=$F_N$) of the address IDL is calculated by the following equation (step S25).

$$F_N=(A+N)/\text{remainder of } N$$

(However, $F_N$=N when the remainder is equal to 0)

In the next step S26, a check is made to see if the field $F_N$ coincides with the field at a time point when the operating mode is switched from the refresh driving mode to the partial writing mode or not. When they are equal, a certain value b is added to the address IDL (=A+N) and the field is changed (step S27). Subsequently, the internal field counter is reset (step S28). The refresh resume address IDL is set into the input line register 16 (step S29). By the above process, the scan line latch data is equal to the value which is obtained by adding the refresh resume address IDL to the address SA (step S30). When the next interruption signal IRQ1 is confirmed, it is set into the driver controller 12 and the refresh driving mode is restarted.

In place of calculating the scan address at a time point when the refresh driving mode is restarted as mentioned above, it is also possible to restart the refresh driving mode from the time point of the end of the partial writing mode without calculating the field. In such a case, the refresh resume address IDL is equal to (A+N).

According to the present invention as described above, since the partial writing mode and the refresh driving mode of the display apparatus are selectively switched on the basis of the switching information from the image information supply side, the partial writing mode and the refresh driving mode can be smoothly switched for the display apparatus such as a ferroelectric liquid crystal panel having the memory performance and temperature dependency. Further, the scanning line and the field at a time point when the refresh driving mode is restarted from the partial writing mode are calculated. In the partial writing mode, the picture data request signal synchronized with the period which is integer times as high as the horizontal sync signal is supplied to the image information supply side. Therefore, the picture quality upon mode switching can be improved.

What is claimed is:

1. A display driving apparatus for causing a display apparatus to display image data, which is supplied together with horizontal and vertical sync signals from a host computer, in a partial writing mode or a refresh driving mode, comprising:

discriminating means for supplying a discrimination signal indicating that said image data is data for the partial writing mode or data for the refresh driving mode;

switching means for selectively switching between the partial writing mode and the refresh driving mode of said display apparatus based on the discrimination signal;

display control means for causing said display means to display the image data in accordance with the mode selected by said switching means at a display rewrite timing, wherein the horizontal and vertical sync signals are received from the host computer asynchronously with the display rewrite timing;

counting means for counting the horizontal sync signal irrespective of the mode switched by said switching means and for resetting the counting in response to input of the vertical sync signal; and calculating means for calculating a refresh resume address at a time when switching from the partial writing mode to the refresh driving mode occurs, based on a count value counted by said counting means.

2. An apparatus according to claim 1, further comprising measuring means for measuring a temperature around said display apparatus, wherein said display control means executes control in the refresh driving mode based on the measured temperature. integer multiple of a period of the horizontal sync signal.

3. An apparatus according to claim 1, further comprising requesting means, wherein, when the partial writing mode is selected by said switching means, said requesting means generates a request signal to the host computer, the request signal being synchronized with a period that is an integer multiple of a period of a horizontal sync signal.

4. An information processing system having a display driving apparatus for causing a display apparatus to display image data, which is supplied together with horizontal and vertical sync signals from a host computer, in a partial writing mode or a refresh driving mode, comprising:

data supply means for supplying the image data to the display driving apparatus;

discriminating means for supplying a discrimination signal indicating that the image data is data for the partial writing mode or data for the refresh driving mode;

switching means for selectively switching between the partial writing mode and the refresh driving mode of said display apparatus based on the discrimination signal;

display control means for causing said display means to display the image data in accordance with the mode selected by said switching means at a display rewrite timing, wherein the horizontal and vertical sync signals are received from the host computer asynchronously with the display rewrite timing;

counting means for counting the horizontal sync signal irrespective of the mode switched by said switching means and for resetting the counting in response to input of the vertical sync signal; and calculating means for calculating a refresh resume address at a time when switching from the partial writing mode to the refresh driving mode occurs, based on a count value counted by said counting means.

5. A system according to claim 4, further comprising measuring means for measuring a temperature around said display apparatus, wherein said display control means executes control in said refresh driving mode based on the measured temperature.

6. A system according to claim 4, further comprising requesting means, wherein, when the partial writing mode is selected by said switching means, said requesting means generates a request signal to the host computer, the request signal being synchronized with a period that is an integer multiple of a period of a horizontal sync signal.

7. A display driving method for causing a display apparatus to display image data, which is supplied together with horizontal and vertical sync signals from a host computer, in a partial writing mode or a refresh driving mode, comprising the steps of:

supplying a discrimination signal to indicate whether said image data is data for the partial writing mode or data for the refresh driving mode;

selectively switching between the partial writing mode and the refresh driving mode of said display apparatus based on the discrimination signal;

displaying the data on said display apparatus in accordance with the mode selected in said switching step at a display rewrite timing, wherein the horizontal and vertical sync signals are received from the host computer asynchronously with the display rewrite timing;

counting the horizontal sync signal irrespective of the mode switched at said selectively switching step and resetting the counting in response to input of the vertical sync signal; and calculating a refresh resume address at a time when switching from the partial writing mode to the refresh driving mode occurs, based on a count value counted at said counting step.

* * * * *

UNITED STATES PATENT AND TRADEMARK OFFICE

CERTIFICATE OF CORRECTION

PATENT NO. : 5,699,075

DATED : December 16, 1997

INVENTOR(S) : KATSUHIRO MIYAMOTO

It is certified that error appears in the above-identified patent and that said Letters Patent is hereby corrected as shown below:

COLUMN 1

Line 31, "plasm" should read --plasma--.
Line 43, "INOUE" should read --Inoue--.

COLUMN 2

Line 32, "Use" should read --use--.

COLUMN 5

Line 23, "Signals" should read --signals--.

COLUMN 10

Line 15, "integer multiple of a period of the" should be deleted.
Line 16, "horizontal sync signal." should be deleted.

Signed and Sealed this

Twenty-first Day of July, 1998

Bruce Lehman

*Attest:*

BRUCE LEHMAN

*Attesting Officer*

*Commissioner of Patents and Trademarks*